United States Patent [19]

McClelland

[11] Patent Number: 4,584,836

[45] Date of Patent: Apr. 29, 1986

[54] STEAM TURBINE RESTART TEMPERATURE MAINTENANCE SYSTEM AND METHOD

[75] Inventor: Thomas R. McClelland, Roselle, N.J.

[73] Assignee: Westinghouse Electric Corp., Pittsburgh, Pa.

[21] Appl. No.: 696,223

[22] Filed: Jan. 29, 1985

[51] Int. Cl.[4] ..... F01K 13/02

[52] U.S. Cl. ..... 60/646; 60/657; 60/656

[58] Field of Search ..... 60/646, 657, 656

[56] References Cited

U.S. PATENT DOCUMENTS

| | | | |
|---|---|---|---|
| 4,173,869 | 11/1979 | Martin, Jr. et al. | 60/646 |
| 4,226,086 | 10/1980 | Binstock et al. | 60/656 |
| 4,228,359 | 10/1980 | Matsumota et al. | 60/646 X |
| 4,282,708 | 8/1981 | Kuribayashi et al. | 60/39.02 |

*Primary Examiner*—Allen M. Ostrager

*Attorney, Agent, or Firm*—R. S. Lombard

[57] ABSTRACT

A restart temperature maintenance system and method for a steam turbine system is disclosed. The restart system utilizes a plurality of electric heating blankets maintained over an air gap to maintain the temperature of the turbine rotor at a desired initial start-up temperature thereby greatly decreasing the time required for warm-up.

11 Claims, 12 Drawing Figures

STEAM TURBINE RESTART TEMPERATURE MAINTENANCE SYSTEM AND METHOD

BACKGROUND OF THE INVENTION

This invention relates to steam turbines generally and in particular to a system and method for decreasing the amount of time required for start-up of a steam turbine during temporary shutdown of the turbine.

In recent years there has been a general decrease in electrical demand in this country by utilities, in particular, which have large steam driven turbines which were designed for constant use. Because of the decrease in electrical demand combined with escalating fuel costs, utilities have been cycling their plants, that is, the plants are selectively shut down for a period of time and then returned to service. A method for the shutdown and restarting of a combined power plant is disclosed in U.S. Pat. No. 4,282,708 issued to Tetsuzo Kuribayashi et al. The Kuribayashi patent discloses a method to supply heated steam to gland sections of a steam turbine in a combined plant, i.e., one having both a steam and a gas turbine, to reduce restarting time of the steam turbine.

Large turbines require a long warm-up period each time they are shut down and allowed to cool off. Generally, present practice during start-up is to run the turbine at low speed for a period of time until critical areas of the machine such as the rotating shaft reach minimum temperatures. For example, if the turbine rotating shaft temperature falls below 250° F., cold-start warming procedure is normally used for restarting the turbine system. This procedure generally includes (1) several hours of applying steam to the turbine to reach the prescribed minimum operating temperature and (2) several additional hours of part speed operation after the turbine has reached the prescribed minimum temperature. In both cases the boiler must be fired at a reasonable rate to achieve minimum steam quality. In a 500 to 750 megawatt system the hourly fuel cost during the warming procedure is approximately $4,000, and typically it takes approximately 4 to 6 hours to achieve minimum operating temperature and an additional 6 to 10 hours of running at part speed warming. From this, it is apparent that the fuel cost alone for restarting the turbine is quite substantial, not to mention other costs such as labor.

SUMMARY OF THE INVENTION

There is provided a restart temperature maintenance system for a steam turbine system wherein the turbine system comprises a steam turbine including a rotating shaft, and an outer metal shell means.

The restart temperature maintenance system comprises fastener means affixed to the outer surface of the metal shell at predetermined positions. Air gap spacer means are included, affixed to the outer surface of the shell. The air gap spacer substantially covers the shell. A plurality of electric heating blanket means of predetermined size and shape are positioned in insulative relationship over the air gap spacer means and are maintained in predetermined position by the fastener means. Heat sensor means are affixed to the outer metal shell of the turbine in predetermined positions. The heat sensor means includes a plurality of heat sensors. Power supply means are included for supplying power to the heating means. Sensor monitor and controller means are provided and are connected in circuit between said power supply means and said heat sensor means. The sensor monitor and controller is for monitoring the heat sensors and when the sensor monitor detects a predetermined low temperature at any of the heat sensors for permitting the power supply to energize the heat blanket or blankets adjacent a detected low temperature heat sensor and for disrupting the power from the power supply when a predetermined high temperature is reached at a heat sensor, whereby during temporary shutdown of a steam turbine system, the turbine rotating shaft is maintained substantially at a desired initial start-up temperature thereby greatly decreasing the time required for warm-up resulting in numerous benefits as hereinafter discussed. A method for reducing the start-up time of the steam turbine system is also disclosed.

BRIEF DESCRIPTION OF THE DRAWINGS

For a better understanding of the present invention, reference may be had to the preferred embodiments as disclosed in the accompanying drawings, in which.

DESCRIPTION OF THE PREFERRED EMBODIMENTS

Figure 1:
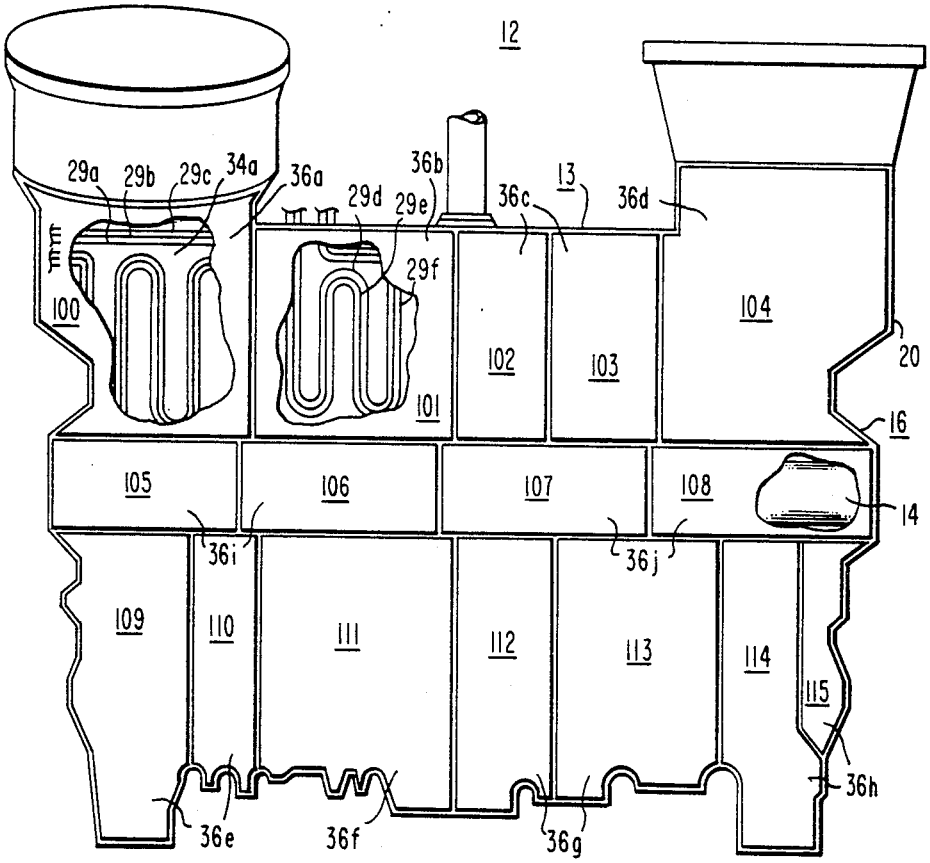
FIG. 1 is a side elevational view of a typical steam turbine partly broken away showing the location of the heating blanket means.
Figure 2:
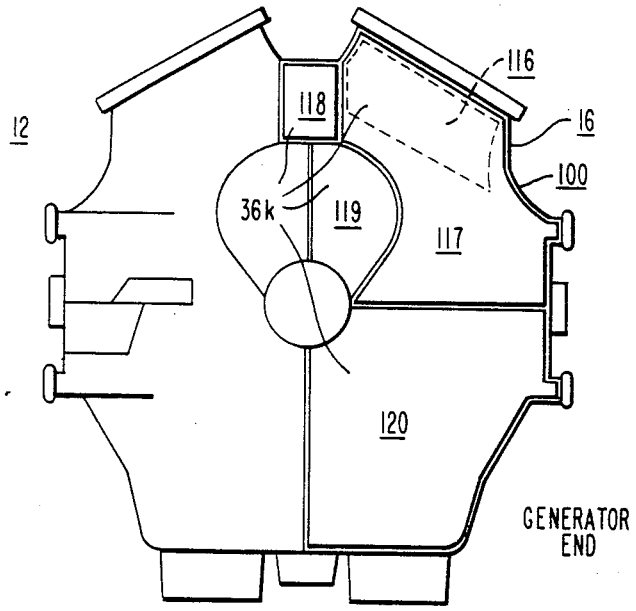
FIG. 2 is an elevational view of the generator end of the steam turbine showing the placement of the heating blanket means.
Figure 3:
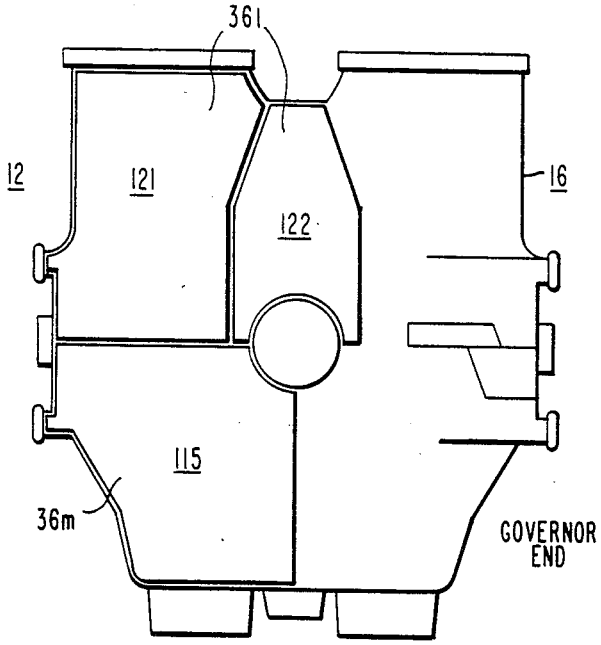
FIG. 3 is an elevational view of the governor end of the steam turbine showing the placement of the heating blanket means.
Figure 5:
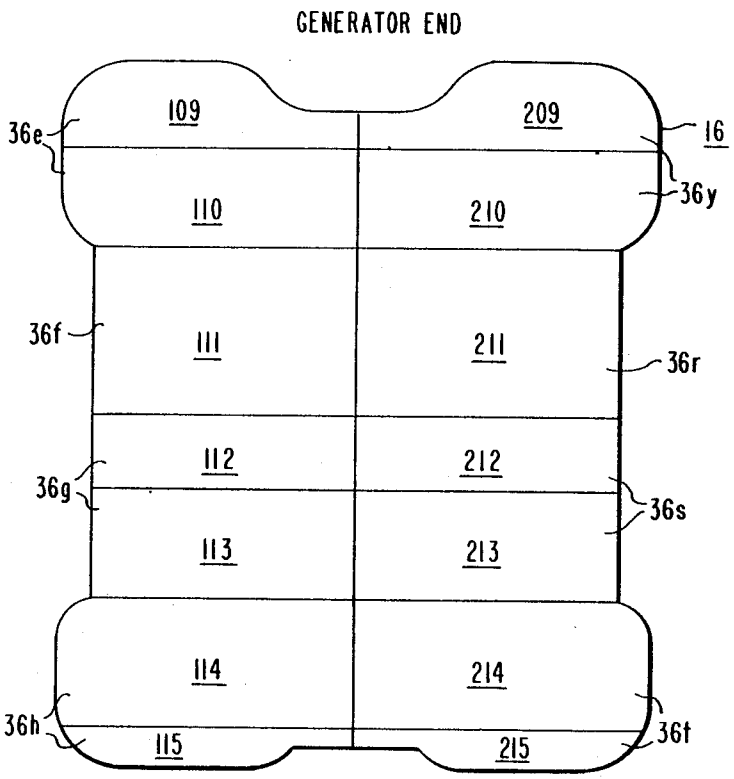
FIG. 5 is a plan view of the lower portion of of the steam turbine showing the location of the heating blanket means.
Figure 4:
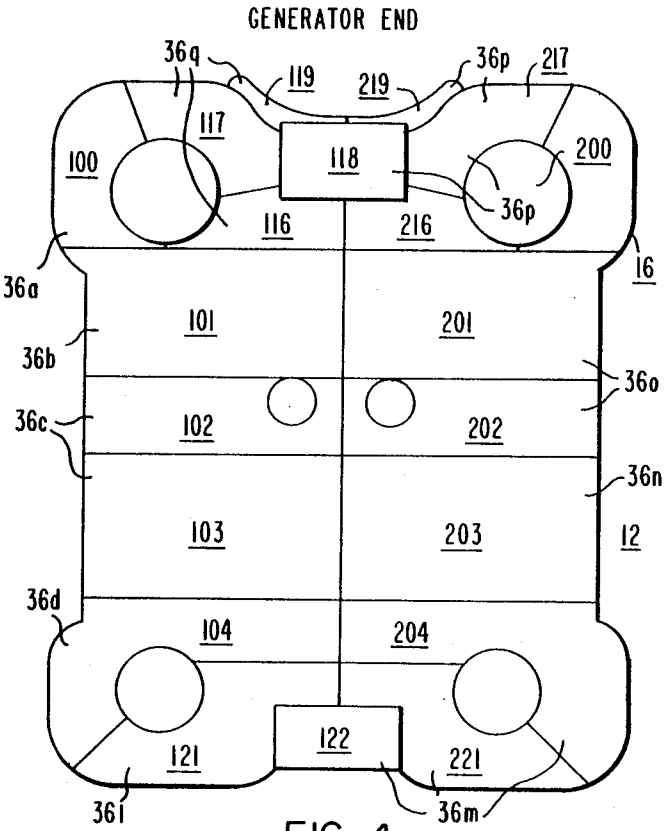
FIG. 4 is a plan view of the upper portion of the steam turbine showing the location of the heating blanket means.
Figure 6:
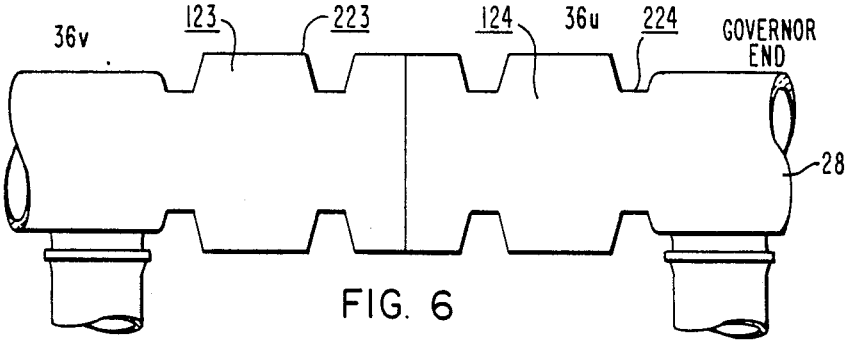
FIG. 6 is a side elevational view of a steam chest showing the location of the heating blanket means.
Figure 7:
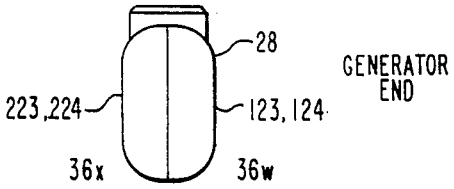
FIG. 7 is a side elevational view of the steam chest showing the placement of the heating blanket means.
Figure 9:
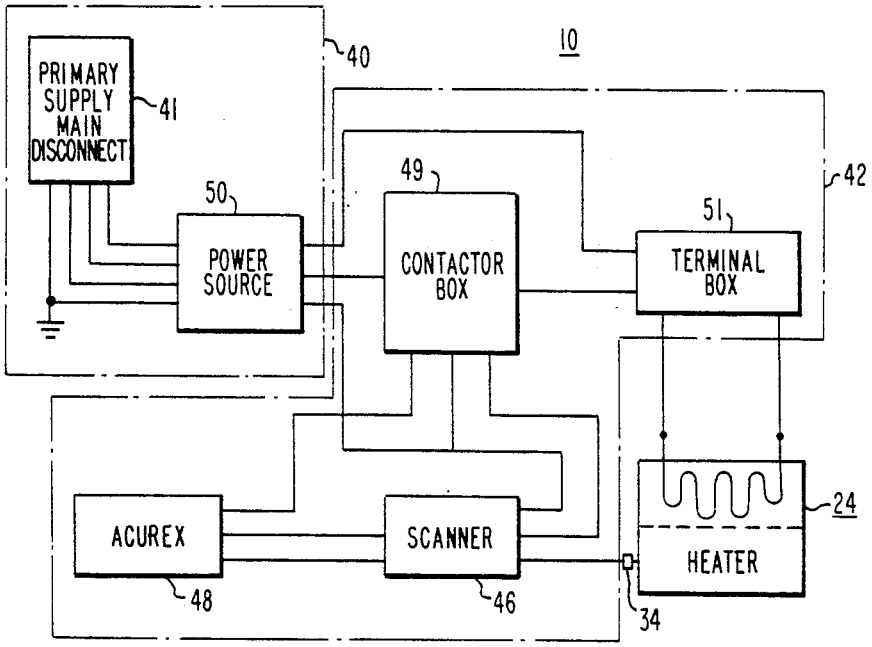
FIG. 9 is a schematic diagram of the turbine heating system.

Referring to FIGS. 1 and 9 there is shown a restart temperature maintenance system 10 for a steam turbine system 12, the turbine system 12 comprises a steam turbine 13. The steam turbine 13 includes a rotating shaft 14 and an outer metal shell means 16 as is known in the art.

Figure 8:
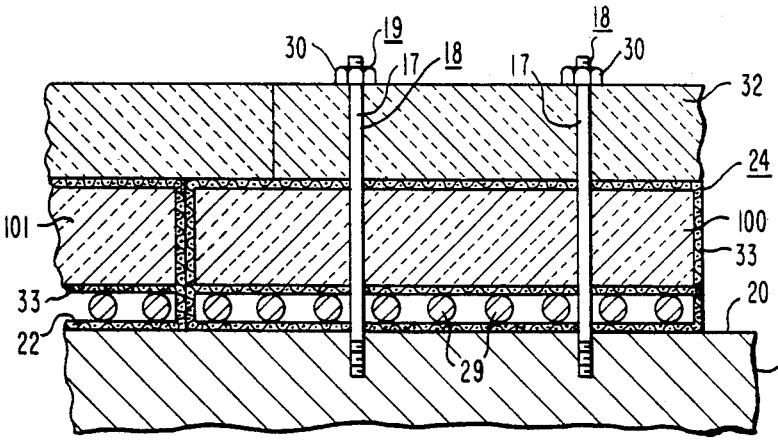
FIG. 8 is a cross-sectional elevational view showing the air gap means and the heating blanket means in relationship to the outer shell of the turbine.

The restart temperature maintenance system 10 comprises fastener means 18 as shown in FIG. 8 affixed to the outer surface 20 of the shell 16. The fastener means 18 is preferably metal pins such as stainless steel pins 17 approximately 6 inches long affixed to the outer shell 20 by welding, for example. The pins 17 are placed in predetermined positions about the entire outer surface 20 of the shell 16 as hereinafter discussed.

With reference to FIG. 8, air gap spacer means 22 is affixed to the outer surface 20 of the shell 16 as hereinbefore described. The air gap spacer means 22 substantially covers the shell 16. Preferably, the spacer means is made of corrugated stainless steel mesh such as manufactured by A.C.S. Industries having 4'×6' average dimensions and provides an air gap of 1/32" over the entire outer surface 20 of the steam turbine system 12.

The turbine heating system 12 further includes a plurality of electric heating blanket means 24 as shown in FIGS. 1–7. The heating blanket means includes a plurality of heating blankets 100–224. The heaing blankets 100–224 are of predetermined size and shape. Blankets 100 through 224 are preferably positioned on the shell 16 such that there is an overlap between blankets to prevent unnecessary heat loss. The overlap is not shown in FIGS. 1–7. For example, in FIG. 1, blanket 100 is positioned on a portion of the exhaust hood 26 and is formed and sized to match the contours and area of that portion of the exhaust hood 26. Blanket 101 adjacent to blanket 100 in FIG. 1 is rectangular in shape and has the dimensions of 6'×4'×2" thick.

Figure 7A:
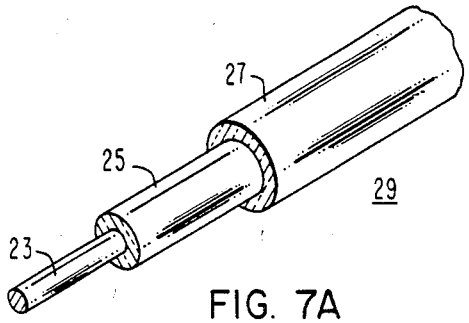
FIG. 7A is an elevational view of a section of the rope heater means showing the various components.

The heating blanket means 24 preferably includes a lightweight, flexible Nichrome wire heater element 23, such as shown in FIG. 7A, manufactured by Electric Arc Inc. rated 100 V DC, 25 amps, 2.5 KW, with each heater element 23 being approximately 49 feet in length. Nichrome is a registered trademark of the Driver-Harris Company. The wire heater element 23 is wrapped with several layers 25 of high temperature ceramic yarn such as manufactured by 3-M Company. The yarn-covered heater 23 is then braided with a pure Inconel mesh 27 such as manufactured by Hoskins Wire Co., which holds the layers 25 of the ceramic yarn tight against the heater 23 allowing the heat to be transmitted to the turbine shell 16. The resultant product is an electrically self-insulated rope heater 29.

With reference to FIG. 8 the blankets 100–224 are designed for ease of removal, one requirement being that the size of each blanket allows easy replacement and handling. The maximum area of any blanket is preferably less than 24 square feet. Blanket configuration and number of rope heaters 29 per blanket can be determined by one skilled in the art. Factors to be considered are amount of area to be covered by the blanket, the contour of the surface to be covered and mass of area to heat in the particular area of the turbine 13. Each rope heater 29 is typically 49 feet in length with 3 feet of cold-tail extension. Each rope heater is rated at 2.5 KW. Two or more heaters 29 are attached to each blanket 24.

The heating blankets 100–224 are constructed from paper templates made of the turbine shell 16 and other turbine system components mentioned previously, such as the steam chest 28. This is to ensure proper coverage of the contour of the turbine shell 16 outer surface 20. The templates are each placed over a 2" layer of 8-pound density, 2300° F. ceramic fiber insulation, for example. The insulation is then cut to match the configuration of the template. Once cut to size, the raw insulation is encased in a corrugated stainless steel meshing such as manufactured by A.C.S. Industries having a mesh size of 4' wide×desired length. The rope heater 29 is mounted to the underside of the meshed insulation blanket using stainless steel retainer rings 30. When the rope heaters 29 have been mounted, a second layer 33 of corrugated stainless steel meshing is placed over the heater face 32 of the blanket 24. The second layer 33 constitutes the air gap spacer means 22. Using this method of attaching second layer 33 to the rope heaters 29 provides a minimum of a 1/32 inch air gap between the rope heater 29 and the surface 20 of the turbine 13 and thus, provides heat transfer or cross-convection between the rope heaters 29 thus maintaining proper thermal gradients should a rope heater 29 fail. The air gap spacer means 22 will keep the failed heater's 29 surrounding area at the desired operating temperature due to cross convection heating from adjacent rope heaters 29. The heater blankets 100–224 are mounted together with the air gap spacer means 22 to the outer shell 16 of the turbine 13 with the stainless steel pins 17 and retainer rings 19 as the fastener means 18 and likewise steam chest 28. This design allows heater blankets 100–224 to be removed and replaced within 12 to 15 minutes. Preferably, each template and heater blanket 100–224 are coded for ease in ordering a replacement. The paper template is transferred onto Mylar for permanent record. Mylar is a proprietary material of the DuPont Company. As already stated, each heating blanket 100–224 is preferably mounted on the turbine shell 16 so that there is an overlap between adjoining heating blankets as shown in FIG. 8 to prevent unnecessary heat loss. The heating blanket means 24 also desirably includes an outer insulation means 32 as shown in FIG. 8. The outer insulation means 32 is preferably made of a material such as a 2" layer of 8-pound density, 2300° F. ceramic fiber insulation and is placed over the heating blanket means 24 and held in place by fasteners 18, for example. The plurality of heating blanket means 24 as shown in FIGS. 1–7, 7A enable the replacement of any heating blanket 24 with relatively little difficulty. The blankets 24 are sized such that they are not cumbersome during installation or removal.

The air gap spacer means 22 provides heat cross-convection between the blankets 100–224 over substantially the entire outer surface of the shell 16 of the steam turbine 13 so that the failure of any one heating blanket 100–224 will not produce a cold spot on the adjacent portion of the outer surface 20 of the turbine 13.

The restart temperature system 10 also includes heat sensor means 34 affixed to the outer metal shell 16 of the steam turbine 13 in predetermined position.

The heating blanket means 24 is positioned in insulative relationship over the air gap means 22 and the heating blanket means 24 is maintained in position in the predetermined position by the fastener means 18 as previously discussed. For example, blanket 100 shown in FIG. 1 constitutes a first zone **36*a*. Three rope heaters 29*a*, 29*b* and 29*c* are part of blanket 100 and have a total power consumption of 7.5 KW. Blanket 101 constitutes a second zone 36*b*, with three rope heaters 29*d*, 29*e* and 29*f*. The zones are sized to approximate equal surface area of the shell 16. The other zones 36*c*–36*x* comprise one to five blankets, as shown in FIGS. 1–7. The heat sensor means 34 preferably are thermocouples 35 such as manufactured by Thermoelectric Model No. 24" SS-TC Type 'K' attached to the turbine shell 16 by thermocouple welds and located at the zones 36*a*–*x*. Referring to FIG. 1, for example, heat sensor 34*a* is located in the upper portion of zone 36*a* which is the position of heating blanket 100**.

By way of specific example, the following partial table of components is provided.

TABLE OF COMPONENTS

| Component | Manufacturer | Model No. |
|---|---|---|
| 48 | Acurex | 1050 |
| 46 | Acurex | Scanner |
| 1CR | Midtex | 157 33T200 |
| 1 CON, 2 CON | Gould | 2200fBA-730AA |
| 1 LT, 2 LT, 3 LT, 4 Lt | Sylvania | 1D1 2620AK1 |
| 1 MRS, 2 MRS, 3 MRS | Electric Arc | MRS |
| 35 | Thermoelectric | Type K |

Figure 10:
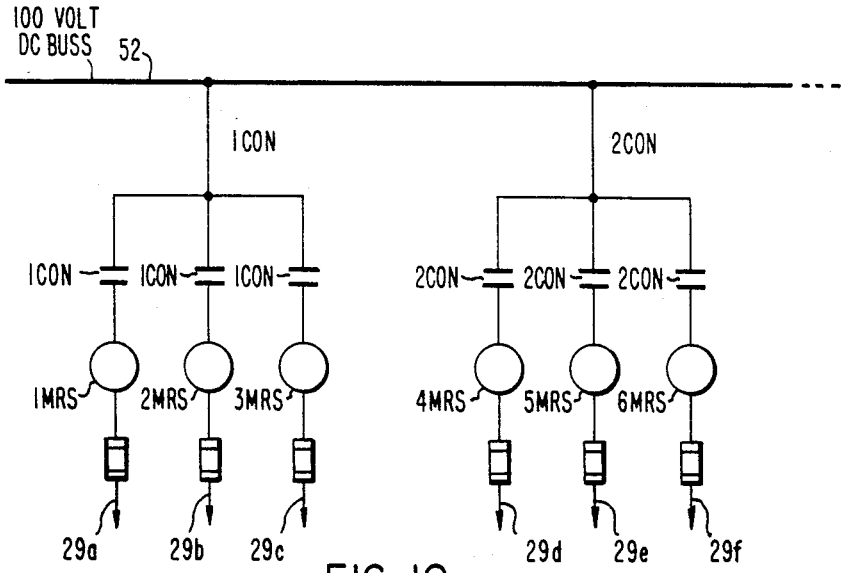
FIG. 10 is a schematic diagram of a portion of the sensor monitor means.

With reference to FIGS. 8–10 power supply means 40 are provided for supplying power to the heating blanket means 34. Sensor monitor and controller means 42 is connected in circuit between the power supply means 40 and the heat sensor means 32. The sensor monitor and controller means 42 is for monitoring the heat sensors 34 and for permitting the power supply 40 when the heat sensor monitor and controller detects a predetermined low temperature at any of the heat sensors 34 to supply power to blanket means 24 adjacent the detected low temperature heat sensor 34. The sensor monitor and controller 42 disrupts the power from power supply 40 when a predetermined high temperature is detected by the sensor monitor and controller 42 at the detected low temperature heat sensor 34 whereby during temporary shutdown of the turbine, the rotating shaft 14 of the steam turbine 13 is maintained substantially at a desired initial start-up temperature such as 250° F. thereby greatly decreasing the time required for warm-up.

Figure 11:
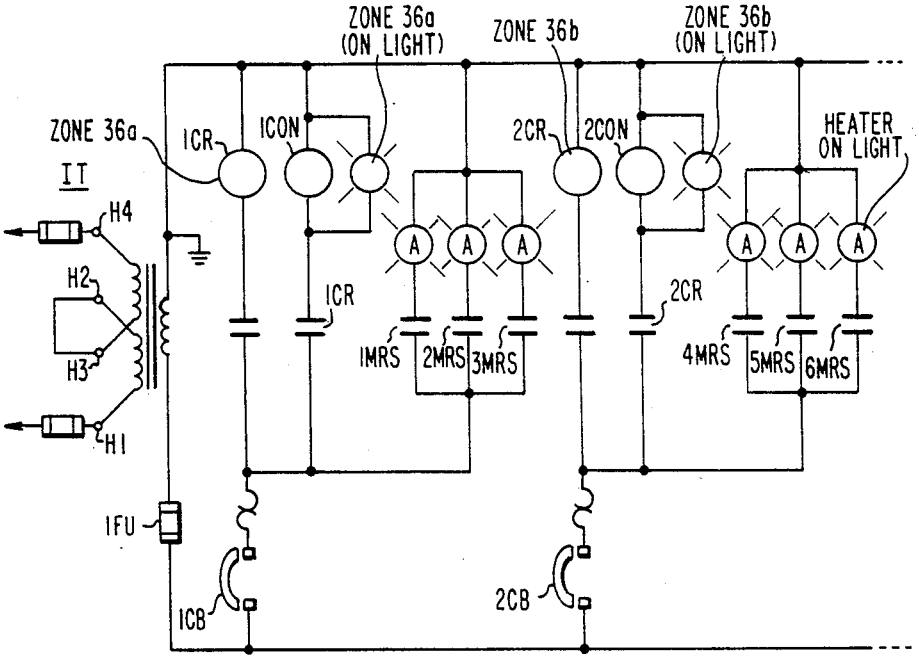
FIG. 11 is a schematic diagram of another portion of the sensor monitor means.

With reference to FIGS. 8–10, the sensor monitor and controller means 40 preferably comprises scanner means 46, computer means 48, contactor means 49 and terminal box means 50. The scanner 46 such as manufactured by Acurex Model No. Scanner, scans the temperature at each sensor 34. Scanner 46 scans each heat sensor 34 2 times per seconds and sends a signal to the computer means 48 representative of the temperature. The computer 48 preferably is one such as that manufactured by Acurex Corporation, Model No. 10/50. Heat sensors 34 are preferably mounted on the entire steam turbine system 12 including high pressure, intermediate pressure elements as well as steam chest 28, intercept valves and boiler feed pumps. The steam turbine outer metal shell 16 preferably is maintained at 550° F.±20° F. to achieve a minimum rotor temperature of 250° F., for example, which will provide a faster warm roll start-up resulting in the turbine being put on line in a substantially shorter time than without the restart temperature maintenance system 10. Shell temperature versus rotor temperature will vary depending on size and design of that turbine. The Acurex computer 48 is a multi-channel data logging computer which receives signals from the scanner corresponding to temperatures detected by the heat sensors 34. The computer 48 is programmed such that when a low temperature, such as 550° F.±20° F., is detected at any heat sensor 34, it sends a 110 volt AC signal to a contactor switch box 49. The low and high temperature settings will vary depending on the specific requirements of the turbine system. A portion of the circuit within switch box 49 is shown in FIG. 11. The remaining circuit within the switch box is repetitive of that shown in FIG. 11. As can be seen from FIG. 11 when the computer closes the contact marked "Zone No. 36*a*". The relay identified as 1 CR is energized thereby closing contact 1 CR which energizes relay 1 CON which in turn closes contact 1 CON identified as "Zone No. 36*a*" in FIG. 10 which results in power being supplied to heater circuits identified as 29*a*, 29*b* and 29*c*, which are all contained in blanket 100. The power supply 40 includes main disconnect 41 and power source 50 which supplies 100 volts DC to the input bus 52 on FIG. 10. For each heater circuit, reed switch coils identified as 1 MRS, 2 MRS, 3 MRS are provided so that an open circuit in any of the heaters may be detected at the contactor means 49 by leaving one of the corresponding contacts open and failing to light lights "A". When sufficient heat is detected on the metal shell 16 at a thermocouple 35, such as 750° F.±20° F. the computer 48 disrupts the signal to the contactor box 49. The power source 50 has a 480 volt AC, 3-phase primary and an 80–100 volt DC high amperage secondary. Terminal box 51 is included for ease of connecting the heaters 29.

It has been found desirable to program the computer 48 such that there is a delay of 30 seconds for example before activating the control box 48 to avoid false readings due to the rapid scanning of scanner 46.

By using the within invention, the steam turbine system 12 may be placed back on line in a few hours rather than one or two shifts. Large turbine units such as 600 megawatts or greater may be maintained at standby temperature for an energy cost of as little as $50 per day, which has been calculated as saving $30,000 to $40,000 of fuel per cycle for such size turbine.

Other benefits that will be derived using the present invention includes improved steam chest 28 temperature matching. Typically, the steam chests cool more rapidly than turbines during shutdowns. This lengthens the start-up time since, upon restart, the steam chest temperature must be raised above the saturation temperature for the existing throttle pressure before transferring from throttle valve to governor valve control. By utilizing the heater blankets 24 of the present invention on steam chests provides a means to realize a faster start-up. In addition, problems with the steam chest and turbine shell cracking caused by stress as generated during cyclic operation should be greatly reduced. Improvement should also be realized in the cyclic life of cylinders, rotors and steam chests by subjecting them to less severe thermal transients during cyclic operation. Also utilizing the present invention, the ability to keep the internal parts of the steam turbine system 12 at a temperature above the dew point during extended shutdown should minimize condensation and associated corrosion difficulties.

I claim:

1. A restart temperature maintenance system for a steam turbine system; said steam turbine system comprising a steam turbine, said turbine including a rotating shaft, an outer metal shell means, said restart temperature maintenance system comprising:

(a) fastener means affixed to the outer surface of said shell means at predetermined positions;

(b) air gap spacer means affixed to the outer surface of said shell means, said air gap spacer means substantially covering said shell means;

(c) a plurality of electric heating blanket means of predetermined size and shape positioned in insulative relationship over said air gap spacer means and said heating blanket means maintained in predetermined position by said fastener means;

(d) heat sensor means affixed to said outer metal shell means of said steam turbine in predetermined position, (e) power supply means for supplying power to said heating blanket means;

(f) heat sensor monitor and controller means connected in circuit between said power supply means and said heat sensor means, said monitor and controller means for monitoring said heat sensor means and permitting said power supply means when said heat sensor monitor and controller means detects a predetermined low temperature at any of said heat sensor means to supply power to said heating blanket means adjacent said detected low temperature heat sensor means and for disrupting the power from said power supply means when a predetermined high temperature is detected by said sensor monitor and controller means at said detected low temperature heat sensor means, whereby during temporary shutdown of said steam turbine system, said turbine shaft is maintained substantially at a desired initial start-up temperature thereby greatly decreasing the time required for warm-up.

2. A method for reducing start-up time of a steam turbine system during temporary shutdown, said turbine system comprising a steam turbine including a rotating shaft, an outer metal shell means, said method comprising:

(a) attaching heating blanket means to substantially the entire outer surface of said outer shell means while maintaining an air gap between said heating blanket means and said outer surface of said outer metal shell;

(b) insulating said heating blanket means;

(c) sensing the temperature of said outer metal shell means at predetermined zones;

(d) energizing said heating blanket means when the sensed temperature at a zone falls to a predetermined low temperature;

(e) heating said low temperature zone until the temperature at said low temperature zone attains a desired high temperature, whereby said turbine rotating shaft is maintained substantially at a desired initial start-up temperature.

3. The restart temperature maintenance system of claim 1, wherein said fastener means comprises stainless steel pins.

4. The restart temperature maintenance system of claim 1, wherein said air gap spacer means comprises stainless steel mesh.

5. The restart temperature maintenance system of claim 1, wherein said heat sensor means comprises thermocouples.

6. The restart temperature maintenance system of claim 1, wherein said heating blanket means comprises insulation means having electrically self-insulated rope heaters fastened thereto in predetermined position.

7. The restart temperature maintenance system of claim 1, wherein heat sensor monitor and controller means comprises sensor scanner means for scanning said heat sensor means and sensing an electrical signal indicative of the temperature sensed by said heat sensor means.

8. The restart temperature maintenance system of claim 7, wherein said heat sensor monitor and controller means further comprises computer means for sensing said electrical signal from said scanner means and for permitting said power supply means to supply power to said heat sensor means when a predetermined low temperature has been detected by said scanner means and disrupting the power from said power supply means to said detected low temperature heat sensor means when a predetermined high temperature is detected by said scanner.

9. The method of claim 2, wherein said predetermined low temperature is about 550° F.±20° F.

10. The method of claim 2, wherein said desired high temperature is about 750° F.±20° F.

11. The method of claim 2 wherein said desired initial rotating shaft start-up temperature is about 250° F.

* * * * *